US005301428A

United States Patent [19]

Wilcox

[11] Patent Number: 5,301,428

[45] Date of Patent: Apr. 12, 1994

[54] UTILITY KNIFE

[75] Inventor: John H. Wilcox, Shaftsbury, Vt.

[73] Assignee: The Stanley Works, New Britain, Conn.

[21] Appl. No.: 848,736

[22] Filed: Mar. 10, 1992

[51] Int. Cl.[5] ..... B26B 3/06

[52] U.S. Cl. ..... 30/162; 30/125; 30/335

[58] Field of Search ..... 30/162, 330, 335, 125, 30/320

[56] References Cited

U.S. PATENT DOCUMENTS

| | | | |
|---|---|---|---|
| 3,604,113 | 9/1971 | Cuscovitch | 30/331 |
| 3,829,967 | 8/1974 | Gilbert | 30/157 |
| 3,872,591 | 3/1975 | Quenot | 30/162 |
| 3,927,473 | 12/1975 | Braginetz | 30/125 |
| 4,068,375 | 1/1978 | Rathbum et al. | 30/125 |
| 4,261,104 | 4/1981 | Cuscovitch | 30/330 |
| 4,509,260 | 4/1985 | Gringer | 30/162 |
| 4,524,518 | 6/1985 | West | 30/330 |
| 4,604,805 | 8/1986 | Krieger | 30/330 |
| 4,621,425 | 11/1986 | Stoutenberg | 30/320 |
| 4,662,070 | 5/1987 | Reddig | 30/125 |
| 4,663,845 | 5/1987 | Weimann | 30/320 |
| 4,939,839 | 7/1990 | Gorst | 30/125 |

FOREIGN PATENT DOCUMENTS 1413679 10/1972 United Kingdom .

*Primary Examiner*—Douglas D. Watts
*Assistant Examiner*—Hwei-Siu Payer
*Attorney, Agent, or Firm*—Chilton, Alix & Van Kirk

[57] ABSTRACT

A releasably locking handle for a retractable blade utility knife The handle is formed from a pair of elongated mating handle halves connected by a central pivot. A slidable blade carrier is supported between the handle halves. The handle has a dual locking mechanism which provides for pivotal opening of the handle only when the blade carrier is in a fully forward position. A magnet which is fixed in the handle slidably supports the blade carrier.

17 Claims, 3 Drawing Sheets

UTILITY KNIFE

BACKGROUND OF THE INVENTION

The invention relates to a retractable blade utility knife handle and more particularly to a retractable blade utility knife handle having a pair of releasably locking, pivotable handle halves.

In retractable-blade utility knives, the blade is slidably movable from a sheathed position to an extended unsheathed position wherein the knife blade projects through an opening in the knife handle to present a cutting edge. Such a utility knife is disclosed in Weimann U.S. Pat. No. 4,663,845, entitled "Utility Knife" wherein the knife incorporates a blade carrier which mounts and supports the blade within the interior of the knife handle for selective longitudinal movement therein. The blade carrier includes a thumb actuated button to release the blade carrier from one of several latching positions for slidably shifting the blade to another longitudinal position. The halves of the knife handle are connected by a central pivot. The handle halves are releasably locked so that they can be pivoted laterally relative to one another when the blade carrier is in any longitudinally shifted position, thereby allowing the blade to be replaced and providing access to a blade storage compartment.

A typical shortcoming of retractable-blade utility knives is the lack of stability of the blade when the knife is forcibly twisted sideways during use. For example, under conditions in which a substantial force is applied to the side of the blade proximate the lower cutting edge, it is possible for the lower edge of the blade to slip off of the blade carrier, thereby freeing the blade to fall out of the handle. Another drawback of conventional utility knife handles is the possibility that the handles can be opened inadvertently. Yet another shortcoming of conventional utility knives is that the blade carrier and blade tend to rattle, as they are not fixed to the handle. A further drawback of conventional retractable blade knives is that if the blade carrier is shifted longitudinally when no blade is installed in the blade carrier, the corners of the blade carrier, on occasion, will become stuck at various locations in the handle, causing the blade carrier to shift or slide irregularly.

SUMMARY OF THE INVENTION

Briefly stated, the invention in a preferred form is a releasably locking retractable blade utility knife handle. The handle, which has a blade receiving opening at one end thereof, is formed from a pair of elongated mating handle halves separated generally along a plane extending longitudinally relative to the handle. The handle halves are connected by a pivot positioned intermediate along the length of the handle, and are movable about the pivot between open and closed positions. A blade carrier is mounted between the handle halves. The blade carrier is adapted for reciprocal movement toward and away from the blade receiving opening. When the blade carrier supports a blade, the blade can be shifted toward and away from a fully extended position. The handle of the invention includes a pair of independently actuated interlocks for locking the handle halves in a closed position. Each interlock extends across the separation plane of the handle halves and is longitudinally spaced from the other interlock by the pivot.

In a preferred embodiment, the first interlock, which is formed on the blade carrier, enables the handle to be opened when the blade carrier is in a fully extended position, but does not permit the handle to be opened when the blade carrier is moved out of a fully extended position. The second interlock is moveable in a direction transverse to the handle halves across the separation plane of the handles for adjustment into and out of a locked condition.

Preferably, the blade carrier also includes extension tabs which keep the blade from slipping off of the blade carrier if the blade is twisted sideways during use.

The blade carrier, which preferably is metal, can be releasably supported on the inner face of one of the handle halves by a magnetic strip mounted inside the handle half.

In a particularly preferred embodiment, the knife handle has tongue-slot locks on both the upper and lower sides of the handle near the blade receiving opening for keeping the blade and blade carrier within the handle while allowing the blade carrier to be slidably shifted in a longitudinal direction.

An object of the invention is to provide a pivotally-opening utility knife handle that is unlikely to be unlocked or opened inadvertently.

Another object of the invention is to provide a retractable blade knife handle that is designed to prevent the blade from becoming dislodged from the blade carrier when the blade is forcibly twisted sideways during use.

Another object of the invention is to provide a utility knife handle in which the blade carrier will shift or slide consistently, without wobble or obstruction, when the blade is absent from the blade carrier.

Yet another object of the invention is to provide a utility knife handle in which rattling of the blade carrier and blade is substantially eliminated.

A further object of the invention is to provide a retractable blade knife handle which affords easy and convenient blade replacement.

Another object of the invention is to provide a new and improved utility knife handle that is easy to manufacture and assemble and which requires a minimum number of components.

Other objects will be in part obvious and in part pointed out more in detail hereinafter.

The invention accordingly consists in the features of construction, combination of elements and arrangement of parts which will be exemplified in the construction hereafter set forth and the scope of the application, which will be indicated in the appended claims.

DETAILED DESCRIPTION OF THE PREFERRED EMBODIMENT

Figure 1:
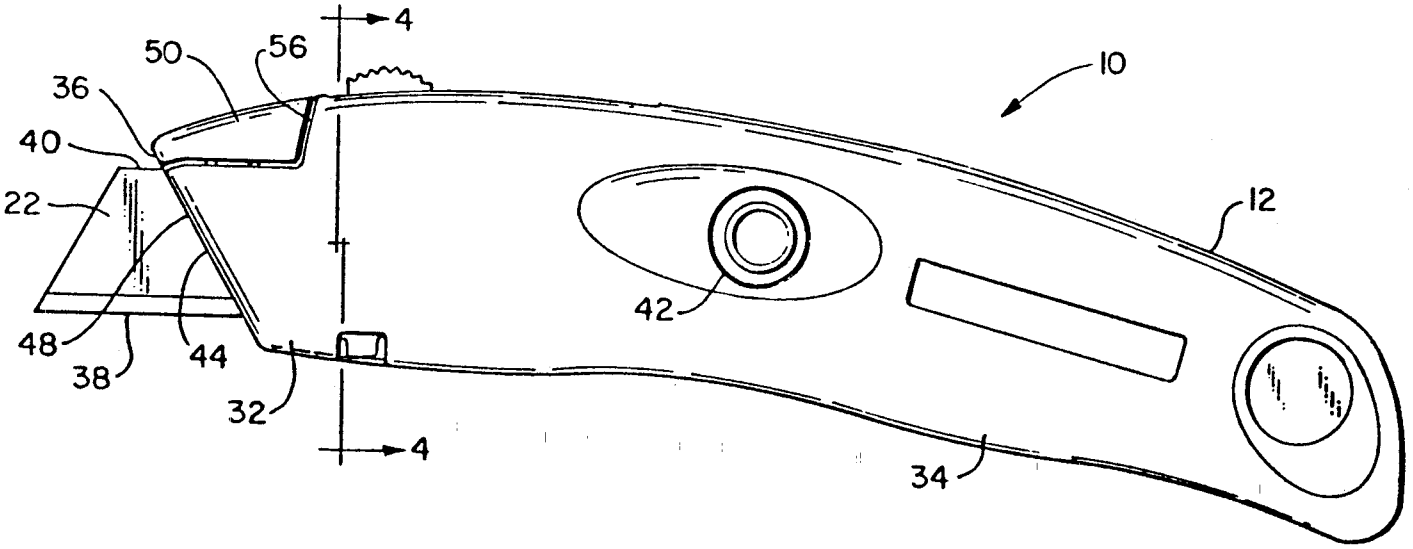
FIG. 1 is an elevational side view of the utility knife handle of the present invention illustrating the knife handle in a closed position with a blade supported therein in a fully extended position.
Figure 2:
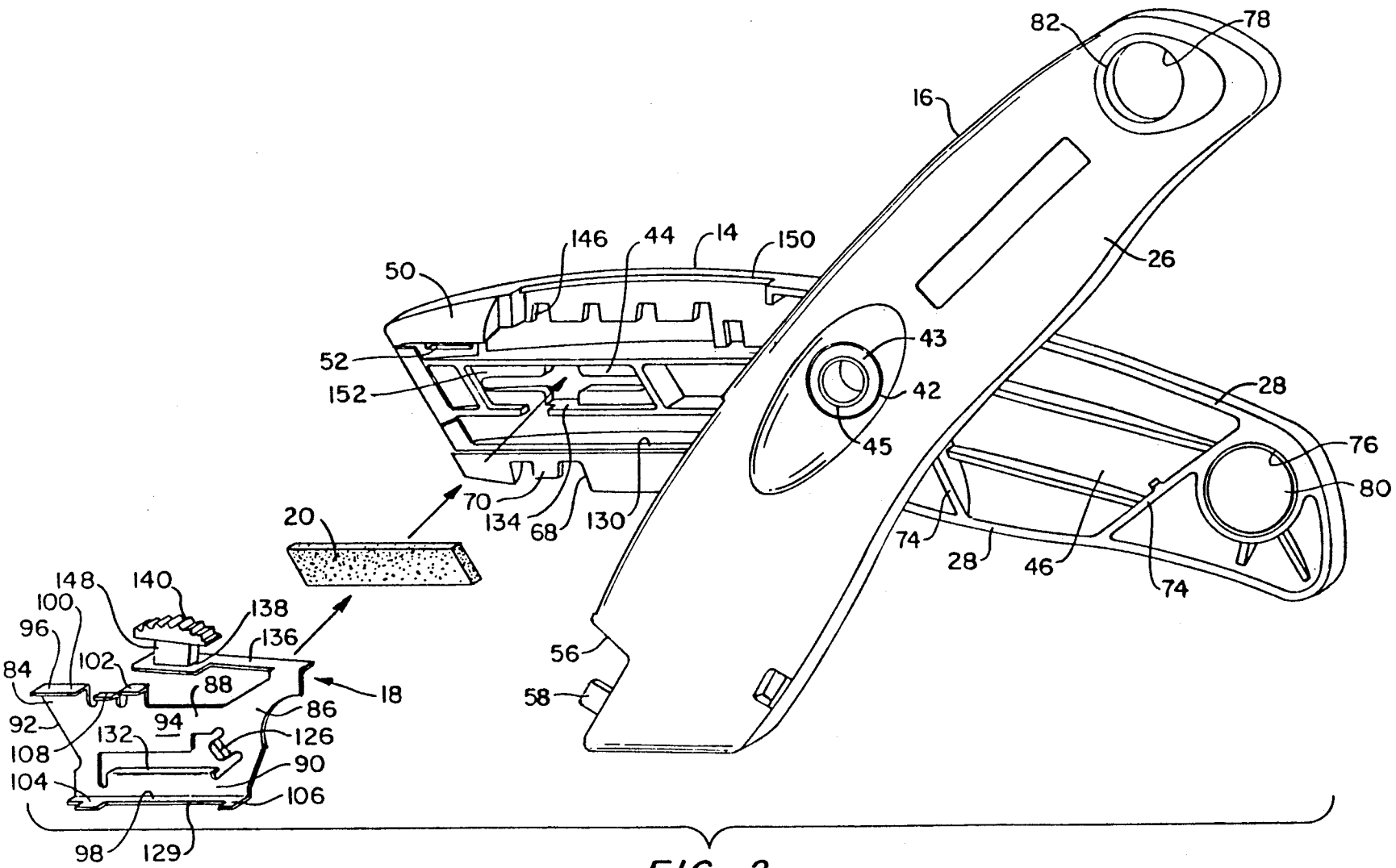
FIG. 2 is an exploded perspective view of the knife handle of FIG. 1, showing the handle in an open position and the assembly relationship of the blade carrier and carrier-retaining magnetic strip in the interior of the handle.
Figure 3:
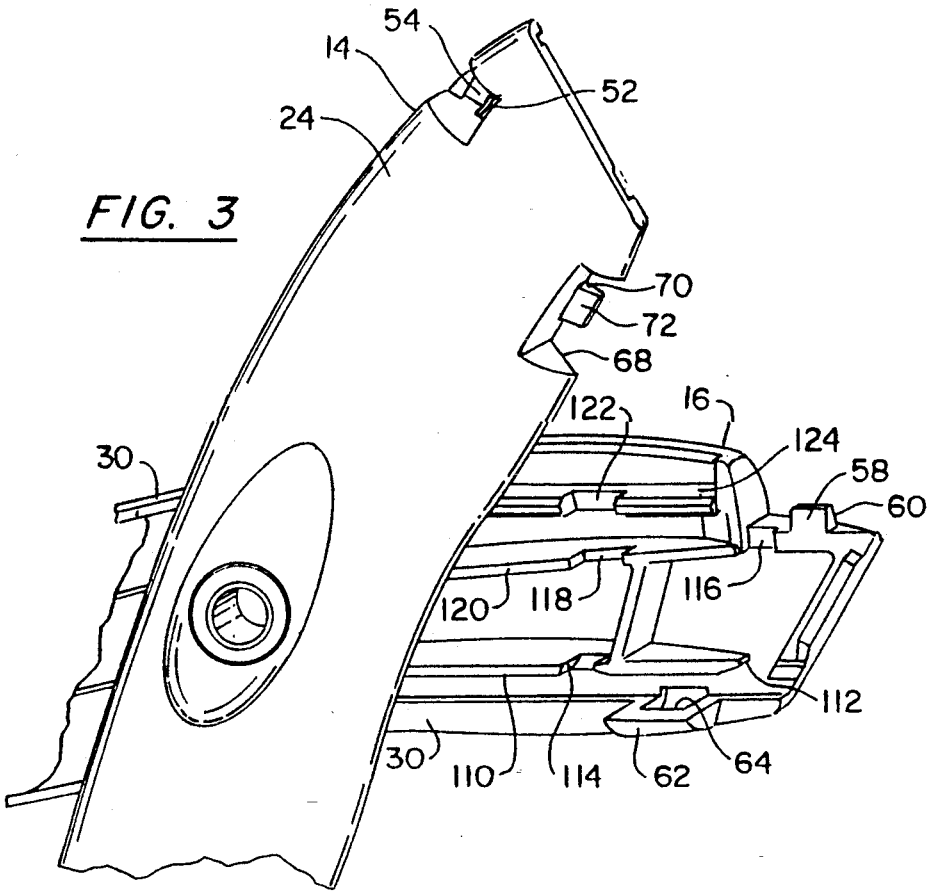
FIG. 3 is a fragmentary perspective view of the forward end of the utility knife handle similar to FIG. 2 but taken from the opposite side of the handle.

With reference to the drawings, and in particular to FIGS. 1-3, a utility knife is generally designated by the numeral 10. The knife 10 includes a handle 12 that is elongated and substantially hollow. The handle 12 comprises a pair of mating handle halves 14,16, a blade carrier 18 slidably mounted between the handle halves 14,16, and a magnet 20 mounted to the interior of handle half 14 for slidably supporting the blade carrier 18. A replaceable cutting blade 22 is mounted on the blade carrier 18 between the handle halves 14,16 in a conventional manner.

The handle halves 14,16 have peripheral side walls 24,26 which terminate in abutting shoulders 28,30. Shoulders 28,30 define mating surfaces which lie in a single longitudinal parting plane traversing the longitudinal center line of the handle 12.

The handle halves 14,16 are pivotally movable in a swivel fashion between a closed position, illustrated in FIG. 1, and an open position, illustrated in FIGS. 2 and 3. In a closed position, the handle halves 14,16 cooperate to provide a handle 12 having a forward blade retainer portion 32 and a rear gripping portion 34. The cutting blade 22 is mounted in the blade retainer portion 32 to project outwardly and forwardly from a front tip or nose 36 of the handle to present a cutting edge 38. The exterior surface of the handle halves 14,16 is suitably contoured and dimensioned to assist the user in holding onto the gripping portion 34 of the handle and to facilitate employment of the knife to perform various cutting tasks by way of appropriate manipulation and application of the cutting edge 38 of the cutting blade 22.

The utility knife handle 12 is particularly well suited for use with a detachable blade having a single cutting edge, such as the blade 22. The front nose 36 of the handle 12 has a generally bevelled configuration relative to the remainder of the handle so that the cutting edge 38 extends forwardly proximate the bottom of the knife. In a preferred form, the blade 22 assumes a conventional trapezoidal shape so that the upper non-cutting edge 40 of the blade is essentially entirely or nearly entirely received within the handle 12 and the blade 22 projects forwardly to terminate at a lower forward blade apex.

With further reference to FIGS. 1 and 2, a pivot 42 forms a pivot axis which extends in a direction transverse to the longitudinal parting plane defined by the mating surfaces of the handle halves 14,16. The pivot 42 is intermediate between the forward blade retainer portion 32 and the rear gripping portion 34 so that in the open position shown in FIG. 2 a blade carrier receiving recess 44 and an internal blade storage compartment 46 are revealed in handle half 14 and access therewith is facilitated. The pivot 42 in a preferred form includes a pair of interlocking bosses 43, 45 which extend inwardly from the handle halves 14,16, respectively, to rotatably interlock. Reference is made to commonly assigned West U.S. Pat. No. 4,524,518, which is incorporated in its entirety herein by reference, as exemplary of the preferred type of pivot.

The blade carrier receiving recess 44 is defined by the handle halves 14,16 and terminates at a forward end in a blade receiving opening 48 which opens forwardly at the front nose 36 of the handle 12. The blade receiving opening 48 is in the form of an elongated slot in the forward end of the handle 12 having a longitudinal axis transverse to the path of travel of the blade carrier 18. The opening may be wider on the ends and narrower in the center, as illustrated and described in Weimann U.S. Pat. No. 4,663,845, which is incorporated herein by reference. The blade receiving opening 48 preferably is dimensioned so that when the handle halves 14,16 are pivoted to the closed position without mounting the blade in the internal blade recess, the width of the blade opening is equal to or slightly greater than the width of the blade to be mounted in the internal blade recess.

With reference to FIGS. 1 and 2, an upper front shoulder 50 of handle half 14 projects transversely from shoulder 28 across the longitudinal parting plane traversing the longitudinal center line of the handle 12 at the upper front portion of handle half 14, and extends rearwardly from the front nose 36 of the handle 12. A slot 52 located in the shoulders 28 and 50 has an engagement surface 54 formed in the shoulder 50. The forward upper portion of handle half 16 is contoured to define a recess 56 which is complementary with the shoulder 50 so that when the handle halves 14,16 are pivoted to a closed position, the shoulder 50 is received in the recess 56. A tongue 58 having an inclined surface 60 projects upwardly from the recess 56. The tongue 58 is dimensioned and correspondingly aligned so that when the handle halves are pivoted to the closed position, the tongue 58 is received in the slot 52 and the inclined surface 60 interacts with the engagement surface 54 to prevent the blade retainer portions of the two handle halves 14,16 from spreading in a direction perpendicular to the longitudinal parting plane defined by the mating surfaces of the handle halves 14, 16.

In a similar manner, a lower front shoulder 62 on handle half 16 projects transversely from shoulder 30 across the longitudinal parting plane traversing the longitudinal center line of the handle 12 at the lower front portion of the handle half 16, and extends rearwardly along part of the forward blade retainer portion 32 of the handle 12. A slot 64 located in the shoulders 30 and 62 has an engagement surface 66 formed in the shoulder 62. The forward lower portion of the handle half 14 has a generally rectangular recess 68 which is complementary with the shoulder 62 of handle half 16 so that when handle halves 14,16 are pivoted to a closed position, the shoulder 62 is received in the lower recess 68. A tongue 70 having an inclined surface 72 projects downwardly within the recess 68. The tongue 70 is dimensioned and correspondingly alignable so that when the handle halves 14,16 are pivoted to a closed position, the tongue 70 is received in the slot 64 and the inclined surface 72 interacts with the engagement surface 66 to prevent the handle halves 14,16 from spreading in a direction perpendicular to the longitudinal parting plane defined by the mating surfaces of the handle halves 14, 16. In a preferred embodiment, the inclined surfaces 60,72 of the tongues 58,70 are inclined at an angle of about 22° relative to longitudinal parting plane defined by the abutting surfaces of the handle halves 14,16. Any angle in the range of approximately 0°-30° relative to the longitudinal parting plane will provide a sufficient interlocking engagement between the inclined surfaces 60,72 of the tongues 58,70, respectively, and engagement surfaces 54,66 of the slots 52,64, respectively.

The blade storage compartment 46 is conveniently formed in the hollow rear portion of handle half 14. The compartment 46 can be employed for housing spare blades. In the preferred embodiment illustrated in FIG. 1, the generally trapezoidal blade storage compartment 46 is defined by a pair of ribs 74 which project integrally from the side wall of the handle half 14 to terminate at the longitudinal plane defined by the abutting shoulders 28,30. The handle halves 14,16 cooperate in a closed position to close the blade storage compartment 46.

With reference to FIGS. 1 and 2, the handle halves 14,16 are further provided at the rear portion thereof with round, transverse openings 76,78, respectively. The transverse openings 76,78 are alignable with each other when the handle halves 14,16 are pivoted to a closed position. The transverse opening 76 in handle half 14 is of a concentric stepped configuration having a smaller diameter on the outer portion of the handle half, proximate the outer wall 24, and a larger diameter on the inner portion. A button 80 is slidably retained in the transverse opening and is dimensioned to be substantially commensurate with the dimensions of the transverse opening except that the outer end of the button is projectable beyond the side wall 24 of handle half 14. The button 80 constitutes one of the two locks of the handle 12. The transverse opening 78 in handle half 16 is of a stepped configuration having a slightly larger diameter on the inner portion than on the outer portion proximate the outer wall 26. The inner portions of transverse openings 76,78 have equal diameters so that when the handle is in a closed position, the button 80 can enter the transverse opening 78, thereby locking the handle 12 in a closed position.

In the preferred embodiment of the lock formed by the button 80 and the openings 76, 78 illustrated in FIG. 2, a rim 82 formed at the transition between the outer and inner portions of the opening 78. The rim defines a stop for the button 80. The location of the rim 82 and the dimensions of the button 80 preferably are such that the button 80 is only partially received in the inner portion of the opening 78. The locking mechanism provided by the button 80 and transverse openings 76,78 can be released by merely pushing the button out of the transverse opening 78 so that the inner surface of the button 80 substantially coincides with the longitudinal parting plane defined by the abutting shoulders 28,30. The details of the button 80 are described in further detail and illustrated in West U.S. Pat. No. 4,524,518, which is commonly assigned and is incorporated herein by reference.

Figure 4:
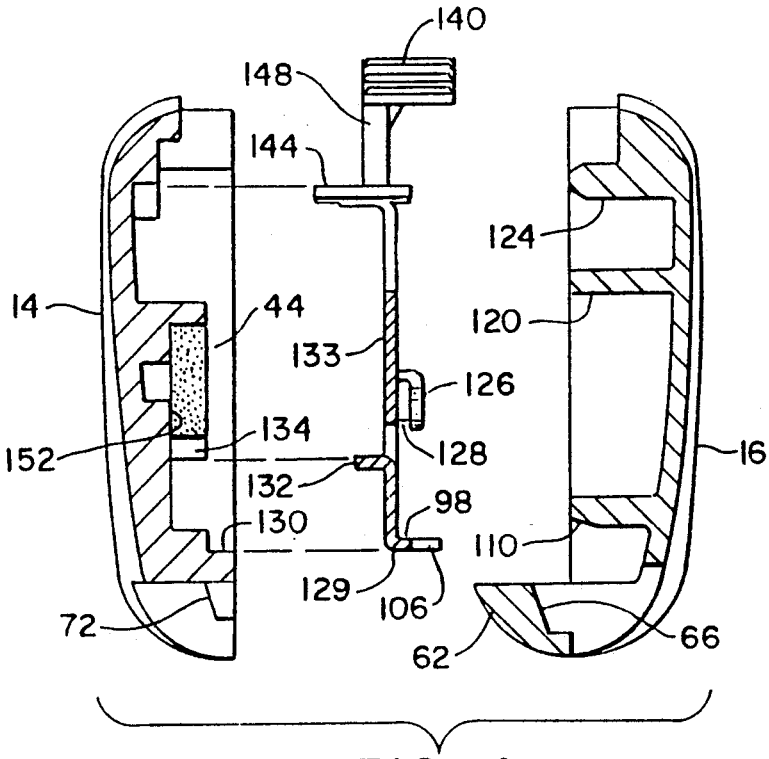
FIG. 4 is an enlarged, exploded section view of the knife handle of FIG. 1 taken along line 4—4 of FIG. 1, with the blade removed.

Referring to FIGS. 2 and 4, the blade carrier 18 is in the form of an integral sheet metal slide which includes for purposes of description forward and rearward ends 84,86, respectively and upper and lower ends 88,90. A generally upright web portion 92 extends between the upper and lower ends 88,90. The web portion 92 has a planar face 94 for abutting against the planar side face of the blade 22 to provide lateral retention and support for the blade 22. A pair of spaced, upper and lower blade-retaining flanges 96,98 are positioned respectively at the upper and lower ends 88,90 of the blade carrier 18, extending outward in the same perpendicular direction from the planar face 94 of the blade carrier 18, for vertical retention and support of the blade 22. The upper flange 96 includes two longitudinally spaced upper flange portions 100,102. A locating lug 108 is positioned between and slightly below the upper flange portions 100, 102, and extends outward and slightly downward from the plane of the web portion 92. The lug 108 is received within one of the locating notches (not shown) in the upper edge 40 of the blade 22 to retain the blade 22 in a fixed longitudinal position relative to the blade carrier 18. A pair of locking tabs 104,106 extend outward from the lower flange 98 in the same plane as the lower flange. The front locking tab 104 is directly below the locating lug 108. The upper and lower flanges 96,98, the locking tabs 104,106 and the locating lug 108 are integrally formed at the respective upper and lower ends of the slide. The locking tabs 104,106 have a length sufficient to cross over the longitudinal parting plane between the handle halves 14, 16 in order to prevent the blade from slipping sideways off of the blade carrier 18 in the event the blade 22 is forcibly twisted sideways during use.

When the blade carrier 18 is mounted in the closed handle halves 14,16, the locking tabs 104,106 bear against a lower interior ledge or guide rail 110 on the handle half 16 to prevent pivotal opening of the handle halves when the blade carrier 18 is withdrawn from its fully forward position. The lower interior guide rail 110 has a pair of longitudinally spaced notches 112, 114 formed therein. A longitudinally extending central rib 120 is formed on the central portion of the inner side of handle half 16 and has a pair of longitudinally spaced notches 116, 118 formed thereon. A longitudinally extending upper rib 124 is formed near shoulder 30 on the upper portion of the inner side of handle half 16 and has a notch 122 formed therein. Notches 114, 118 and 122 are equally spaced from the pivot 42. Furthermore, notches 112 and 116 are equally spaced from the pivot 42. When the blade carrier 18 is in a fully forward position, the locking tab 104 is aligned with the notches 112,116, and the locking tab 106 is aligned with the notches 114, 118 and 122. When button 80 has been depressed to unlock the rear gripping portion 34 of the handle 12 and the handle halves 14, 16 are pivotally opened, notches 112 and 116 allow for the passage of locking tab 104 therethrough, and notches 114,118 and 122 allow for the passage of locking tab 106 therethrough. The handle 12 can be opened only when both of the interlocks are unlocked, i.e., when the blade carrier 18 is in a fully forward position in the manner described above, in order to align the locking tabs 104,106 with the corresponding notches, and when the button 80 is depressed such that it lies entirely on the side of the handle half parting plane that includes handle half 14.

While in the particularly preferred embodiment the locking tabs 104, 106 serve the dual function of preventing the handle from being opened when the blade carrier is in a retracted position and keeping the blade on the blade carrier, these two functions can also be served by separate and distinct components of the utility knife.

The blade carrier 18 further includes a blade retaining tab 126, which extends outwardly from the planar face 94 of the web portion 92 and is positioned intermediate the upper and lower flanges 96,98 toward the rearward end 86. The retaining tab 126 is generally oriented obliquely relative to the flanges 96,98 so as to engage the oblique back end edge of the blade 22 (not shown) and to fix the longitudinal position of the blade 22. The retaining tab 126 is integrally formed with the blade carrier 18 and, as shown in FIG. 4, extends outwardly and forwardly from the planar face 94 to form a recess or trapping channel 128 between the retaining tab 126 and the planar face 94 roughly commensurate with or slightly greater than, the thickness of the blade. When the blade 22 is mounted in the blade carrier 18, the rear edge of the blade and a portion of the rear end of the blade is held within the recess 128 to laterally retain the blade in the blade carrier 18.

The blade carrier 18 is adapted to shift or slide longitudinally between the handle halves 14, 16. The lower flange 98 and the tabs 104,106 of the blade carrier 18 have a lower surface 129 which is planar and extends longitudinally to form a guide surface to ride on a bottom guide rail 130 on the inner side of the handle half 14. A blade carrier guide rail 132 is positioned on the planar back side surface 133 of the web portion 92 of the blade carrier 18 and extends outwardly therefrom in a perpendicular direction opposite to the direction of extension of the upper and lower flanges 96,98. The blade carrier guide rail 132 is integrally formed with the blade carrier 18 by stamping, bending or the like, and extends longitudinally along the blade carrier 18 parallel to the upper and lower flanges. The blade carrier guide rail 132 is positioned intermediate the upper and lower ends 88,90 of the blade carrier 18 so as to cooperatively engage the lower edge of a longitudinally extending lower central guide rail 134 on the handle half 14. Consequently, the blade carrier guide rail 132 and the lower surface 129 of the blade carrier 18 cooperatively engage the lower central guide rail 134 and bottom guide rail 130 on the handle half 14 to retain and guide the blade carrier 18 and the blade 22 for longitudinal movement between the retracted sheathed position and the extended unsheathed position.

A resilient button arm 136 is integrally formed at the rearward portion at the upper end 88 of the blade carrier so as to extend forwardly and slightly upwardly therefrom. The button arm 136 has a rectangular slot 138 therethrough for mounting a thumb button 140 by staking or the like. An outwardly projecting latching tab 144 is positioned at the forward terminus or distal end of the button arm 136, as shown in FIG. 4. The latching tab 144 is biased upwardly by the resilience of the button arm so as to be received in any one of four notches 146 in the top interior of handle half 14 in a conventional manner. This feature of the invention is further described in commonly assigned patents to West, U.S. Pat. No. 4,524,518, and Stoutenberg, U.S. Pat. No. 4,621,425 incorporated herein by reference.

The notches 146 in the top interior of the handle half 14 are longitudinally spaced to define multiple extended or unsheathed positions of the blade 22 and a single sheathed or fully retracted position. The first unsheathed position generally exposes the pointed tip of the blade for purposes of scoring. The remaining unsheathed positions are general cutting positions. In the fully extended position of the blade 22, the blade carrier 18 is in a fully forward position relative to the blade receiving opening 48. A stem 148 of the thumb button 140 extends through a longitudinal slot 150 formed at the top of the handle halves 14,16 so as to mount the button 140 for longitudinal movement in the slot 150. The blade carrier 18 may be manually shifted in a longitudinal direction by pressing the thumb button 140 to unlatch the latching tab 144 from one of the respective notches and thereafter longitudinally moving the blade 18 with respect to the handle halves 14,16.

Preferably, the blade carrier 18 is a sheet metal component integrally formed by cutting and stamping, punching or the like. Economy of manufacture is attained with the compact configuration of the finished blade carrier 18 and the blank from making the blade carrier 18, and a stable blade carrier 18 is thus obtained.

The blade carrier 18 is retained in handle half 14 by the elongated, flat magnet 20 which is fixed in a longitudinally extending cavity 152 which opens into the blade carrier receiving recess 44 in the handle half 14. The magnet 20, which extends longitudinally, substantially prevents rattling of the blade carrier 18 and blade 22. At least a portion of the blade carrier 18 abuts against the magnet 20 along the full extent of travel of the blade carrier 18. The magnet 20 also prevents wobble of the blade carrier 18 when no blade is installed. Preferably, the force of the magnet 20 is sufficient to retain the blade carrier 18 in situations in which the handle halves 14,16 are opened and the handle 12 is turned in any direction. The strength of the magnet 20 can, but need not necessarily, assist in supporting the blade on the blade carrier. The strength of the magnet 20 is sufficiently moderate, however, to enable the blade carrier 18 to slide longitudinally between the handle halves 14,16.

As can be seen, the utility knife handle of the present invention provides increased blade stability and reduces rattling while affording easy and convenient blade replacement and economy of manufacture. As will be apparent to persons skilled in the art, various modifications and adaptations of the structure above described will be readily apparent without departure from the spirit and scope of the invention, the scope of which is defined in the appended claims.

What is claimed is:

1. In a retractable blade utility knife handle having a front end including a blade receiving opening and comprising a pair of elongated mating handle halves separated generally along a separation plane extending longitudinally of the handle, the handle halves being connected by a pivot positioned intermediate along the length thereof and being movable about the pivot between open and closed positions, and a blade carrier mounted between the handle halves for reciprocable movement toward and away from a fully forward position relative to the blade receiving opening to shift a blade mounted on the blade carrier toward and away from a fully extended position, the improvement wherein the handle is provided with first and second independently actuated interlocks for locking the handle halves in the closed position, each of the first and second interlocks in their locked condition including means extending across the separation plane of the handle halves for providing interference to pivotal opening of the handle halves, the first interlock being positioned adjacent said front end and the second interlock being longitudinally spaced therefrom by the pivot, the first interlock including a first movable locking portion which is formed on the blade carrier and is movable longitudinally relative to the handle in a direction generally parallel to the separation plane of the handle halves into and out of an unlocked condition when the blade carrier is adjusted into and out of a fully forward position, respectively.

2. The utility knife handle of claim 1, wherein the second interlock includes a second movable locking portion which is connected to the handle and is movable transversely of the handle halves across the separation plane of the halves for adjustment into and out of a locked condition.

3. The utility knife handle of claim 1, wherein the first movable locking portion includes a locking tab, and the first interlock further includes a complementary ledge on one of the handle halves whereby the tab bears against the ledge to prevent pivotal opening of the handle halves when the blade carrier is withdrawn from its fully forward position.

4. The utility knife handle of claim 3, wherein the ledge has a notch formed therein adapted for the passage of the locking tab therethrough when the blade carrier is in its fully forward position.

5. The utility knife handle of claim 4, wherein the locking tab comprises a pair of locking tabs and the notch comprises a pair of notches adapted to allow passage of the locking tabs therethrough.

6. The utility knife handle of claim 1, wherein the blade carrier is metal and a magnet is mounted in a stationary position in one of the handle halves for supporting the blade carrier.

7. The utility knife handle of claim 1, wherein the second interlock comprises alignable transverse openings in the pair of handle halves and a button received in one of the transverse openings, the button being transversely slidable to be at least partially received in the other of the transverse openings to thereby secure the handle halves in a closed position.

8. The utility knife handle of claim 7, wherein a portion of the button projects outwardly from the handle halves when the second interlock is unlocked.

9. The utility knife handle of claim 1, wherein the handle includes lateral retaining means positioned adjacent the blade receiving opening for resisting lateral separation of the handle halves in their closed position, the lateral retaining means including interengaging surfaces on each handle half that cooperatively interfere to prevent lateral separation of the handle halves.

10. The utility knife handle of claim 1, wherein the blade carrier is metal and a magnet is mounted in the handle in a stationary position for slidably supporting the blade carrier during its reciprocal movement.

11. In a retractable blade utility knife handle having a front end including a blade receiving opening and comprising a pair of elongated mating handle halves separated generally along a plane extending longitudinally of the handle, the handle halves being connected by a pivot positioned intermediate along the length thereof and being movable about the pivot between open and closed positions, and a blade carrier mounted between the handle halves for reciprocable movement toward and away from a fully forward position relative to the blade receiving opening to shift a blade mounted on the blade carrier toward and away from a fully extended position, the improvement wherein the handle is provided with a pair of independently actuated interlocks for locking the handle halves in the closed position, one of the interlocks including a locking tab formed on the blade carrier and extending across the separation plane, and a complementary ledge on one of the handle halves whereby the tab bears against the ledge to prevent pivotal opening of the handle halves when the blade carrier is withdrawn from its fully forward position, the ledge having a notch formed therein adapted for passage of the locking tab therethrough when the blade carrier is in its fully forward position, and the other of the interlocks comprising alignable transverse openings in the handle halves and a button received in one transverse opening, the button being transversely slidable to be received in the other transverse opening to thereby secure the handle halves in a closed position.

12. In a retractable blade utility knife handle having a front end including a blade receiving opening and comprising a pair of elongated mating handle halves separated generally along a plane extending longitudinally of the handle, the handle halves being connected by a pivot positioned intermediate along the length thereof and being movable about the pivot between open and closed positions, and a metal blade carrier mounted between the handle halves for reciprocable movement toward and away from a fully forward position relative to the blade receiving opening to shift a blade mounted on the carrier toward and away from a fully extended position, the improvement wherein the handle is provided with first and second independently actuated interlocks for locking the handle halves in the closed position, the first interlock including a first movable locking portion which is formed on the blade carrier and is movable longitudinally relative to the handle into and out of an unlocked condition when the blade carrier is adjusted into and out of a fully forward position, respectively, the second interlock including a second movable locking portion which is movably connected to the handle and is movable transversely of the handle halves across the separation plane of the halves for adjustment into and out of a locked condition, the blade carrier being slidably supported by a magnet mounted in a stationary position in one of the handle halves.

13. The utility knife handle of claim 12, wherein the first movable locking portion includes a locking tab extending across the separation plane, and the first interlock further includes a complementary ledge on one of the handle halves which bears against the tab to prevent pivotal opening of the handle halves when the blade carrier is withdrawn from its fully forward position, the ledge having a notch formed therein adapted for the passage of the locking tab therethrough to permit pivotal opening of the handle when the blade carrier is in its fully forward position.

14. The utility knife of claim 13, wherein the second interlock includes alignable transverse openings in the pair of handle halves and a button received in one transverse opening, the button forming the second movable locking portion and being transversely slidable to be at least partially received in the other transverse opening to thereby secure the handle halves in a closed position, and wherein the handle further includes lateral retaining means positioned near the blade receiving opening, the lateral retaining means including, on each handle half, an extension which projects across the separation plane between the handle halves, a slot formed adjacent the extension, and a tongue adapted to be received in the slot formed on the other handle half.

15. The utility knife handle of claim 12, wherein the second interlock comprises alignable transverse openings in the pair of handle halves and a button received in one transverse opening, the button forming the second movable locking portion and being transversely slidable to be at least partially received in the other transverse opening to thereby secure the handle halves in a closed position.

16. The utility knife handle of claim 15, wherein a portion of the button projects outwardly from the handle halves when the second movable locking portion is moved out of a locked condition.

17. The utility knife handle of claim 12, wherein the handle includes lateral retaining means positioned adjacent the blade receiving opening for resisting lateral separation of the handle halves in their closed position, the lateral retaining means including interengaging surfaces on each handle half that cooperatively interfere to prevent lateral separation of the handle halves.

* * * * *